US006612775B1

(12) United States Patent
Hewitt

(10) Patent No.: US 6,612,775 B1
(45) Date of Patent: Sep. 2, 2003

(54) HYDRAULIC WATERCRAFT LIFT

(76) Inventor: Larry Hewitt, 709 14 W. P.O. Box 111, Nicollet, MN (US) 56074

( * ) Notice: Subject to any disclaimer, the term of this patent is extended or adjusted under 35 U.S.C. 154(b) by 0 days.

(21) Appl. No.: 10/165,288

(22) Filed: Jun. 6, 2002

(51) Int. Cl.[7] ..... B63C 3/06
(52) U.S. Cl. ..... 405/3; 405/4; 405/7; 114/44
(58) Field of Search ..... 405/3, 1, 4, 7; 114/44, 45, 263

(56) References Cited

U.S. PATENT DOCUMENTS

| | | | | |
|---|---|---|---|---|
| 2,963,176 A | * | 12/1960 | Smith | 414/680 |
| 4,895,479 A | | 1/1990 | Michaelsen | |
| 4,900,187 A | | 2/1990 | Uchida | |
| 5,090,841 A | * | 2/1992 | Penick et al. | 405/3 |
| 5,184,914 A | | 2/1993 | Basta | |
| 5,224,569 A | * | 7/1993 | Hewitt et al. | 187/259 |
| 5,275,505 A | | 1/1994 | Wilcox | |
| 5,485,798 A | | 1/1996 | Samoian | |
| 5,890,835 A | * | 4/1999 | Basta et al. | 405/3 |
| 5,908,264 A | | 6/1999 | Hey | |
| 5,919,000 A | | 7/1999 | Unkle | |
| 6,308,652 B1 | * | 10/2001 | O'Neill | 114/263 |
| 6,318,929 B1 | | 11/2001 | Basta | |

OTHER PUBLICATIONS

Basta Marine INC Over–Center ™ Gravity Locking Device Lifts®, undated, 2 pages.*

* cited by examiner

*Primary Examiner*—J. J. Swann
*Assistant Examiner*—Katherine Mitchell
(74) *Attorney, Agent, or Firm*—D L Tschida

(57) ABSTRACT

A watercraft lift having hydraulic cylinders secured to lift towers and pivot axles located above the water surface to raise and lower a cradle that is secured to a surrounding support framework with lift frames that radiate from the framework and cradle corners. Length adjustable legs depend from the framework to appropriately elevate and position the cradle and framework relative to the surface level of the waterway. Brace arms extend from the lift towers to the forward ends of the support framework. The cylinders rotate between a parallel condition to the top of the cradle, when fully elevated, and an inclined condition, when the cradle is fully lowered. The cylinders remain at all times substantially above the water.

15 Claims, 5 Drawing Sheets

HYDRAULIC WATERCRAFT LIFT

BACKGROUND OF THE INVENTION

The present invention relates to watercraft lifts and, in particular, to a watercraft cradle that is pivotally mounted to a framework and that is raised and lowered via hydraulic cylinders that are mounted above the water surface.

Numerous styles of watercraft lifts have been developed for storing a watercraft in an elevated condition above a lake, river or other waterway. Such lifts typically include a variety of linkages and frameworks that cooperate with a watercraft cradle to raise and lower the craft for use or storage. Associated awning-type covers are frequently supported to the frameworks to protect supported watercraft, such as motorboats, sail boats, personal watercraft etc., from the elements.

Many lifts provide chain or belt linkages that couple to a cradle and/or framework and are operated with the aid of a motor or hand wheel. The cradles can comprise simple slings or padded bunks that are mounted to multi-section frames and linkage arms that pivot in response to movement of a manual or electromechanical drive linkage.

A variety of lifts have also been developed that include a hydraulic linkage to raise and lower the cradle. These lifts provide a submerged cylinder that is secured to a support frame and the cradle. A reciprocating piston pivots the cradle or intervening linkage arms to raise and lower the cradle and watercraft. Several of these lifts are shown at U.S. Pat. Nos. 4,895,479; 4,900,187; 5,184,914; 5,275,505; 5,485,798; 5,908,264; 5,919,000; and 6,318,929.

Because the hydraulic cylinder of the foregoing lifts is normally submerged, a heavy-duty cylinder is required. Special care is also required to prevent infiltration of water into the cylinder, where it can mix with the hydraulic fluid. Care must also be taken to alleviate rust and pitting at the cylinder and piston, which can affect lift operation, such as by damaging provided isolation seals.

The present invention was developed to provide a hydraulically operated watercraft lift wherein a hydraulic cylinder is substantially isolated from the deleterious effects of water immersion. The cylinder is mounted to pivot from a support framework at a location where the cylinder and piston are elevated above the water. Only a distal portion of the piston is periodically submerged as a support cradle is lowered, but is wiped free of water as it is retracted.

SUMMARY OF THE INVENTION

It is accordingly a primary object of the invention to provide a watercraft lift having a hydraulic lift linkage that is normally elevated above the adjoining waterway.

It is a further object of the invention to provide a lift wherein a piston is partially submerged only as a watercraft support cradle is lowered.

It is a further object of the invention to provide a lift wherein the cylinder is mounted to pivot at a support framework.

It is a further object of the invention to provide a support framework having pivot towers that are braced by members that extend the length of the framework.

It is a further object of the invention to provide a cradle that pivots at forward and aft ends and wherein at least one hydraulic cylinder is pivotally mounted to a braced tower and to the aft end of the cradle to pivot the cradle.

It is a further object of the invention to provide bracing at the cradle and framework.

The foregoing objects, advantages and distinctions of the invention, among others, are obtained in a lift having a rectangular-shaped cradle that is secured to a surrounding support framework with H-shaped lift frames that radiate from corners of the support framework. Length adjustable legs depend from the framework to appropriately elevate and position the cradle and lift relative to the surface of the waterway. Lift towers rise from the aft or shore-end of the support framework and brace arms extend from the aft towers to the forward ends of the support framework.

A pair of hydraulic cylinders are secured to pivot at the aft lift towers and reciprocating pistons are pivotally secured to the cradle. The cylinders rotate to lie parallel to the top of the cradle when the cradle is fully elevated. When the cradle is fully lowered, the pistons are fully extended and the cylinders are rotated to an obtuse angle relative to top of the cradle. A portion of each piston is then exposed to the water. The cylinders at all times, however, remain above the water. The pistons are wiped free of water and dirt as they are extended and retracted to prevent migration of water into the cylinders and hydraulic fluid.

A variety of modifications and improvements are also disclosed that can be adapted singularly or in combination with the lift assembly.

Still other objects, advantages, distinctions and constructions of the invention will become more apparent from the following description with respect to the appended drawings. Similar components and assemblies are referred to in the various drawings with similar alphanumeric reference characters. Various features of the invention may also be configured with other features in different combinations. The description should therefore not be literally construed in limitation of the invention. Rather, the invention should be interpreted within the broad scope of the further appended claims.

DESCRIPTION OF THE PREFERRED EMBODIMENT

Figure 1:
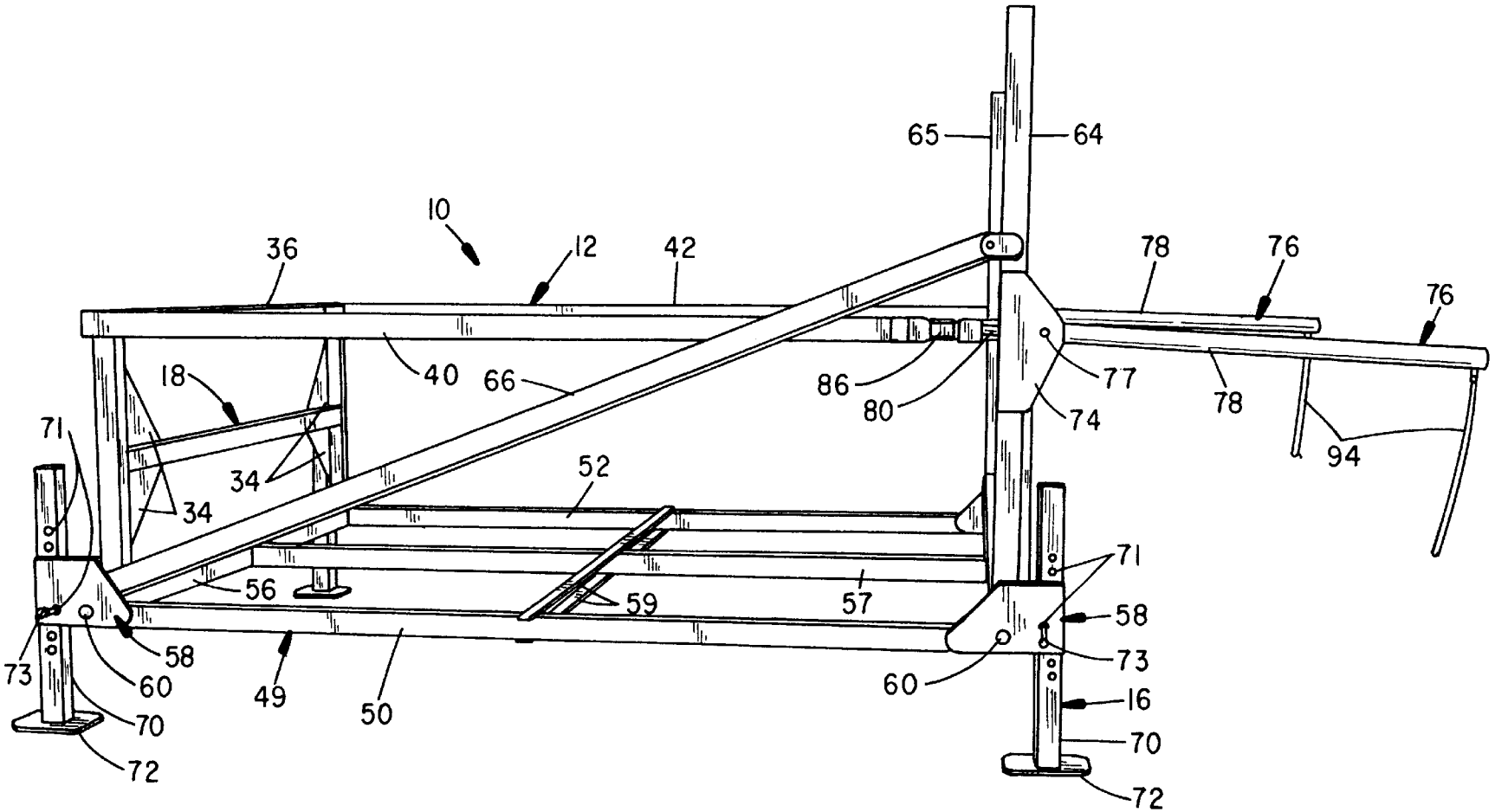
FIG. 1 is a perspective drawing showing a side view of the watercraft lift with the cradle elevated to a watercraft storage position.
Figure 2:
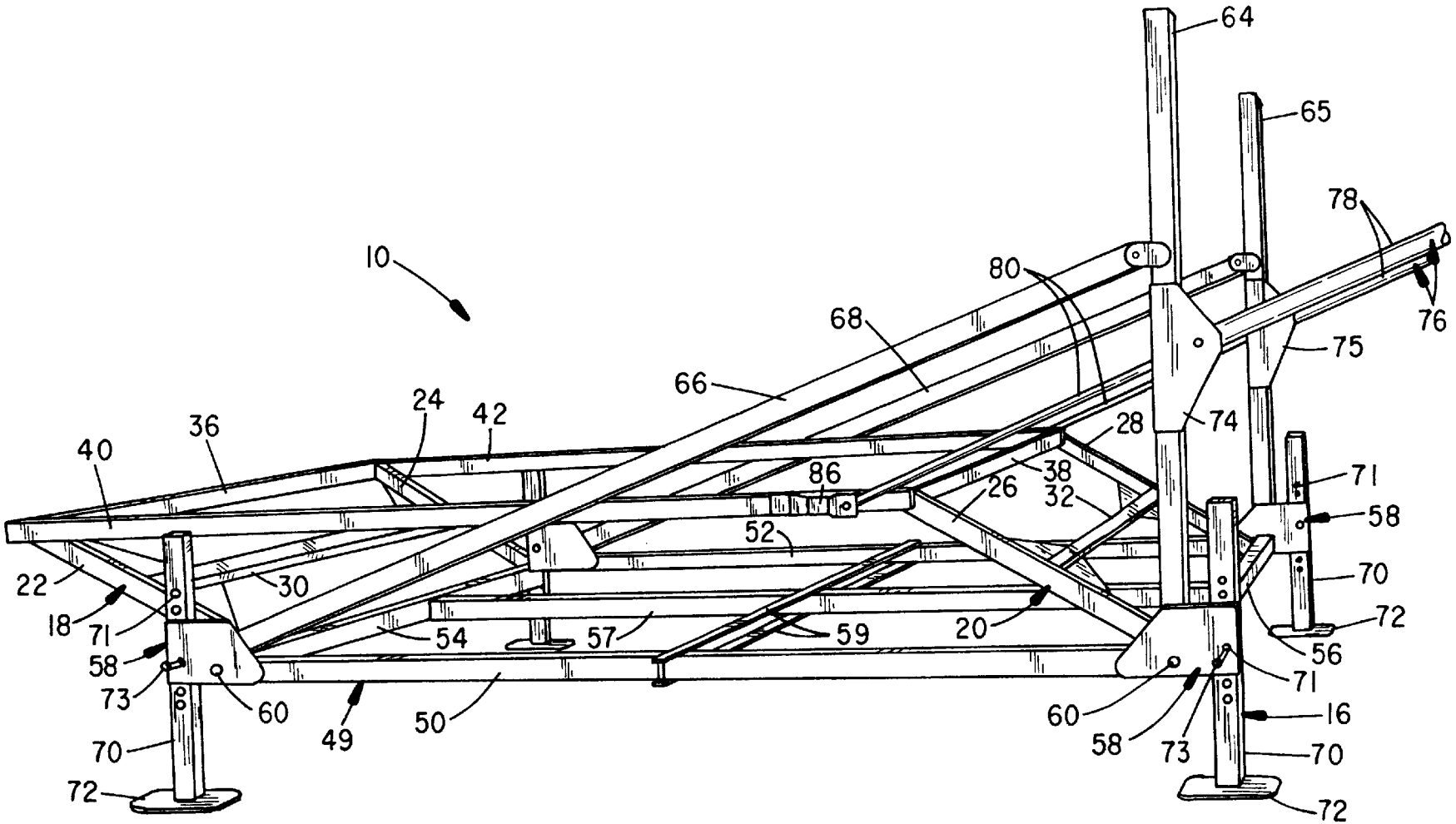
FIG. 2 is a perspective drawing showing a side view of the watercraft lift with the cradle partially lowered.
Figure 3:
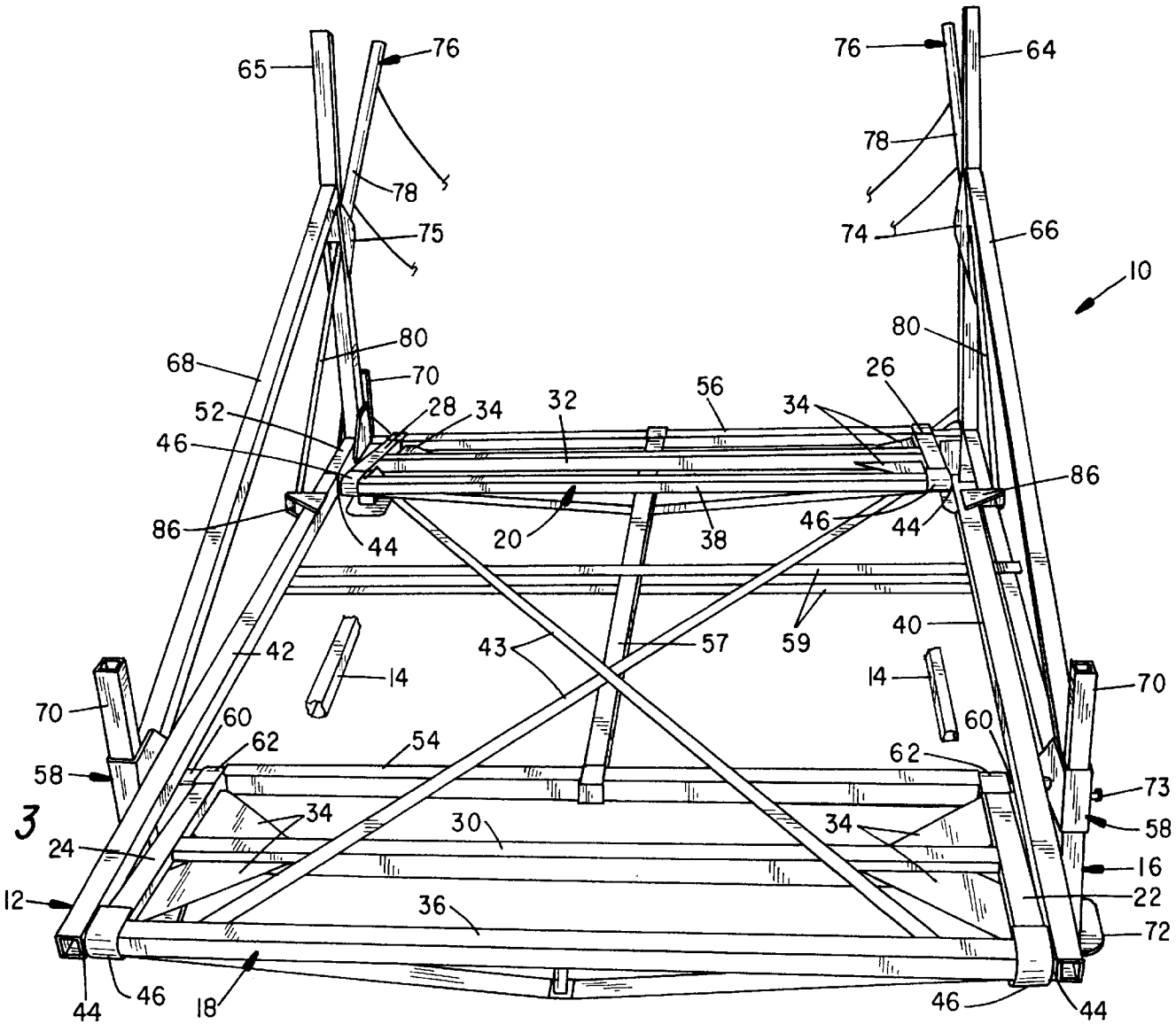
FIG. 3 is a perspective drawing showing an end view of the watercraft lift with the cradle fully lowered.

Referring to FIGS. 1, 2 and 3, views are shown to the watercraft lift 10 as it appears as the cradle 12 is lowered from a fully raised, storage condition to partially raised and fully lowered, submerged conditions. Portions of watercraft support bunks 14 that mount to the cradle are shown. Depending upon the watercraft, the numbers, positioning and mounting of the bunks 14 to the cradle 12 is varied in conventional fashion. The type of bunks 14 can also be varied from padded runners to rollers to slings to combinations of these components.

The cradle 12 is supported to a base frame 16 with fore and aft, H-shaped lift frames 18 and 20. Each frame 18 and 20 includes a pair of pull arms 22 and 24 and 26 and 28. Cross brace arms 30 and 32 extend medially between the pull arms 22–26. Gussets 34 stabilize the pull arms 22–28 relative to the cross arms 30 and 32.

The cradle 12 is constructed in a rectangular shape and includes fore and aft top cross arms 36 and 38 and longitudinal side rails 40 and 42. Diagonal struts 43 are secured between the bottom corners of the top cross arms 36 and 38 to bridge the arms 36 and 38 and add strength. Stub pivot axles 44 secured to the corners of the longitudinal side rails 40 and 42 (e.g. by welding) extend into the ends of the cross arms 36 and 38. Fasteners (e.g. threaded bolts) secure the axles 44 to the cross arms 36 and 38.

Yoke collar ends 46 are secured adjacent the coupling to the ends of the pull arms 22–28 adjacent the ends of the cross arms 36 and 38. The yoke collars 46 are mounted over the axles 44 such that the cradle 12 can pivot and is raised and lowered as the lift frames 18 and 20 are pivoted relative to a support framework 49 at the base frame 16.

The support framework 49 exhibits a rectangular shape and surrounds the cradle 12 is a generally concentric manner. The framework 49 includes longitudinal side rails 50 and 52 and fore and aft cross arms 54 and 56. The longitudinal side rails 50 and 52 and fore and aft cross arms 54 and 56 are secured to corner bracket assemblies 58. A longitudinal brace rail 57 extends between the cross arms 54 and 56 and strap braces 59 stabilize the spacing between the rails 50, 52 and 57. Stub axles 60 extend from the corner brackets 58 into the ends of the cross arms 54 and 56 and are secured with threaded fasteners.

Yoke collar ends 62 mounted to the bottom ends of the pull arms 22–28 are secured adjacent the ends of the cross arms 54 and 56 and the brackets 58. The yoke collar ends 62 mount over the axles 60 such that the cradle 12 can pivot relative to the framework 49 as the lift frames 18 and 20 are pivoted and the cradle 12 is raised and lowered.

Upright lift towers 64 and 65 project from the aft end or shore-side brackets 58 and brace arms 66 and 68 extend the length of the lift 10 from the towers 64 and 65 to the forward corner brackets 58. Legs 70 having support pads 72 depend from each bracket 58. Overlapping holes 71 at the legs 70 and brackets 58 can be selectively aligned and pinned with lynch pins 73 or other fasteners to properly adjust the elevation of the framework 49 to the bed of the waterway.

Figure 4:
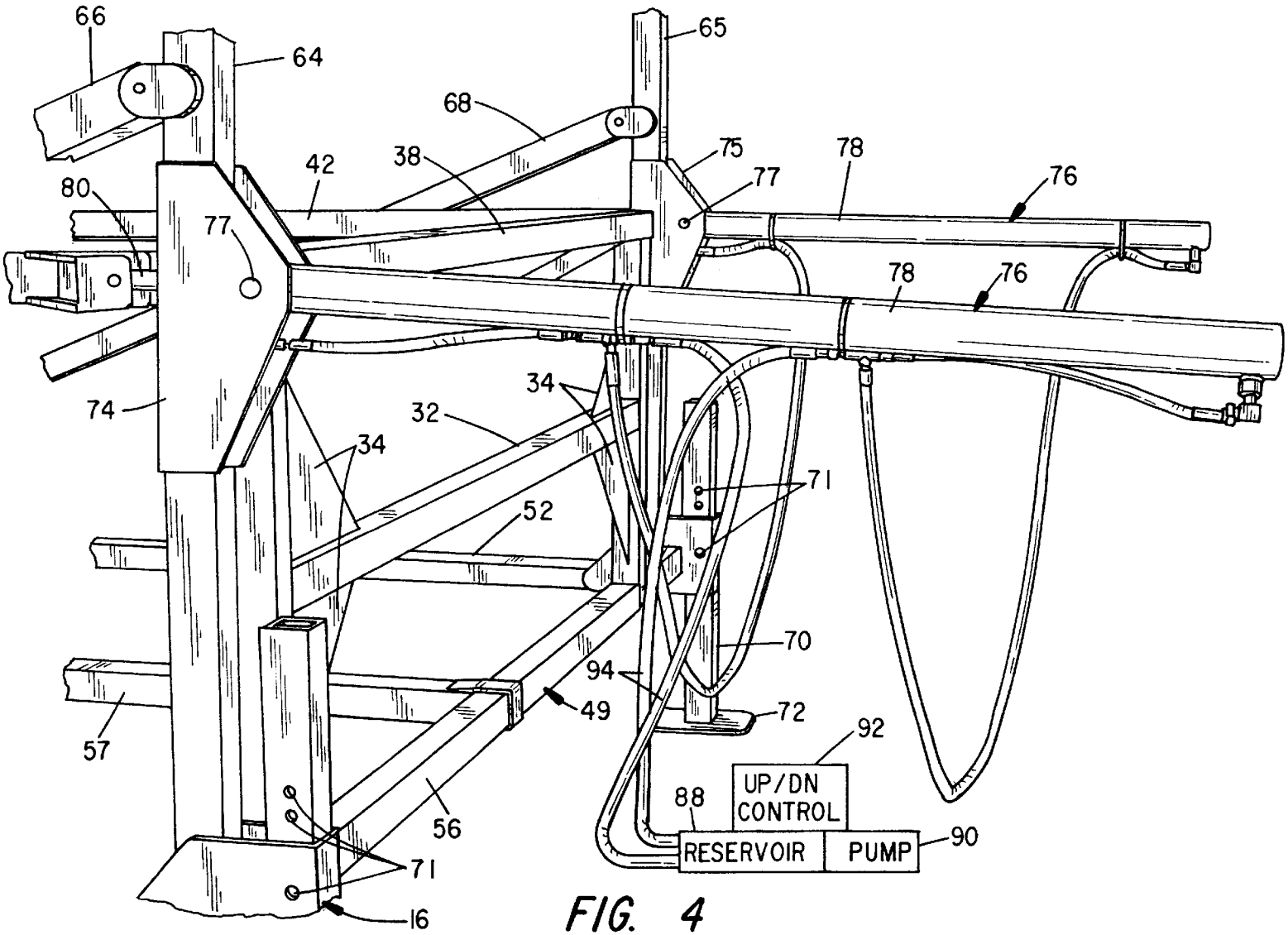
FIG. 4 is a detailed perspective drawing showing a sectioned view of the lift towers with the cradle fully raised.

With additional attention to FIG. 4 and mounted approximately midway along the lift towers 64 and 65 are pivot brackets 74 and 75. The pivot brackets 74 and 75 each support [Each bracket 74 supports] a hydraulic cylinder assembly 76 comprised of a cylinder housing 78 and a piston 80 from a pivot axle 77 that extends from the sides of a cylinder housing 78 and through the brackets 74 and 75. The cylinder housings 78 are thereby supported at all times above the water. A cover or canopy (not shown) that typically spans the top of the framework 49 shelters the supported watercraft and the cylinder housings 78 from exposure to UV light, rain etc.

Figure 5:
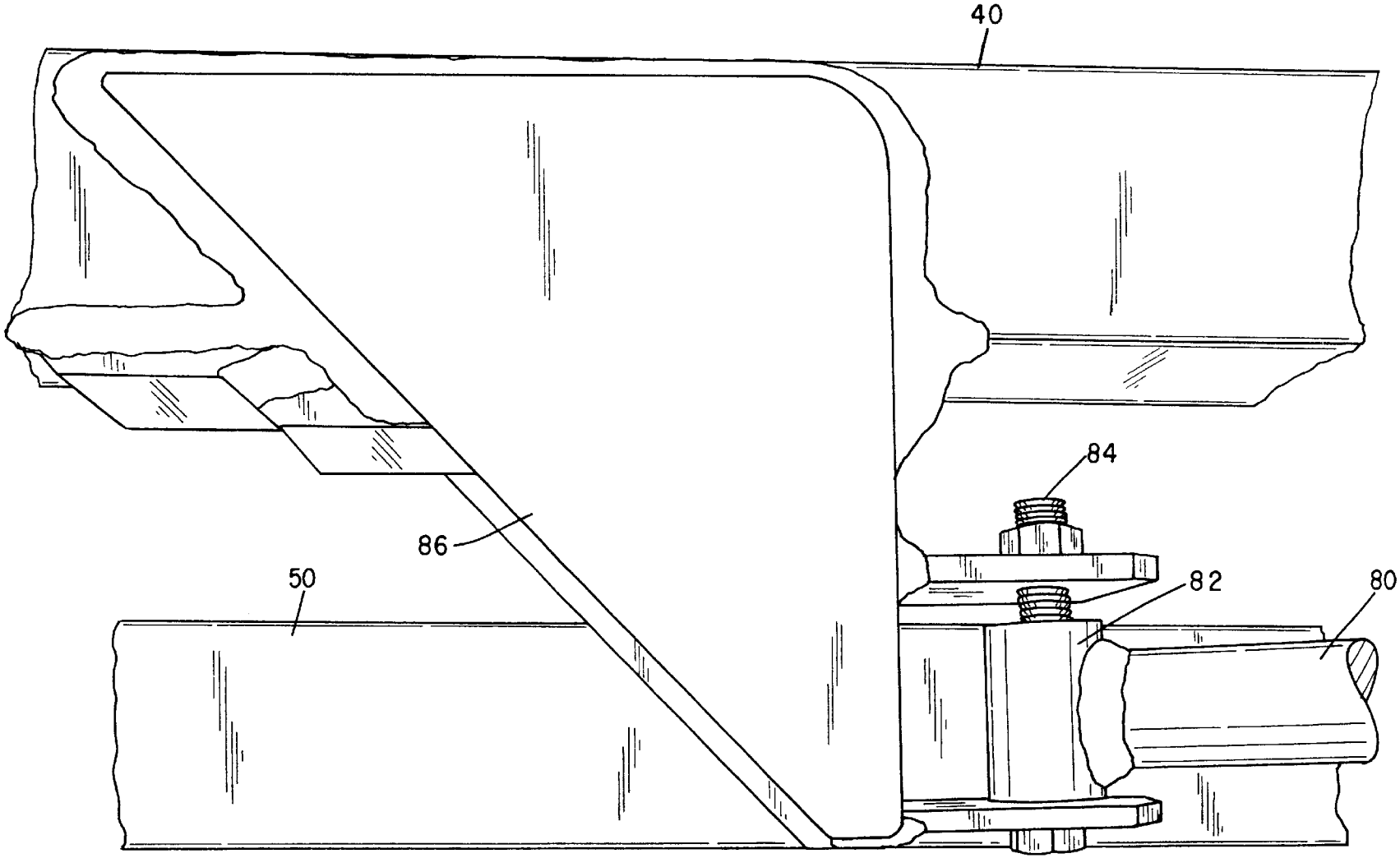
FIG. 5 shows a detailed view of the pivot joint between one of the pistons and the cradle.

A piston 80 is mounted for reciprocating motion from each cylinder housing 78 The distal end of each piston 80 is fitted with a collar 82 shown at FIG. 5. A pivot pin or fastener 84 secures each collar 82 to a gusset pivot bracket 86 secured to the longitudinal rails 40 and 42 near the yoke ends 46 at the cross arm 38. A hydraulic fluid supply reservoir 88, pump 90 and up/down controls 92 are coupled to the cylinder housings 78 via lengths of hosing 94. Hydraulic fluid is appropriately directed through the cylinder housings 78 to extend and retract the pistons 80. The reservoir 88, pump 90 and controls 92 are typically arrayed on or near the support framework 49 or the adjoining wharf or dock, but preferably are covered or located with minimal exposure to the environment.

The cylinder assemblies 76 are selected with a piston movement sufficient to manipulate the cradle 12 between the fully elevated to fully lowered conditions shown at FIGS. 1 and 3. Each cylinder housing 78 is fitted with seals and wipers or scrapers (not shown) that wipe water and dirt from the pistons 80 as they extend and retract. Although single stage cylinders 76 are shown, various other multi-stage, telescoping cylinders can be used. In all instances, the cylinders 76 are sized to the anticipated loading at the cradle.

As noted from FIGS. 1–3, as the cradle 12 rotates between fully elevated and fully lowered conditions, the cylinder housings 78 rotate from a horizontal orientation lying parallel to the cradle 12 to an inclined orientation relative to the longitudinal rails 40 and 42. In all conditions, however, each hydraulic cylinder 76 is substantially supported above the water and sheltered from the incursion of water into the cylinder housings 78. Expensive repairs are thereby avoided and improved lift operation is achieved due to enhanced leverages that are obtained.

While the invention has been described with respect to a presently preferred assembly and considered improvements or alternatives thereto, still other constructions may be suggested to those skilled in the art. For example, the configuration of the pivot joints, the types and sizes of the bunks 14 and/or the configurations of the cradle 12 and support frame 49 can be varied. The frame members need not be tubular and the support framework 49 might exhibit a non-rectangular shape. The type and number of cylinders 76 or telescoping sections at the hydraulic cylinders can be varied. Several of the disclosed features can also be used independently and/or be combined in different combinations. The foregoing description should therefore not be literally construed and should instead be construed to include all those embodiments within the spirit and scope of the following claims.

What is claimed is:

1. Watercraft lift apparatus, comprising:

a) a submersible base framework including a plurality of longitudinal and cross frame members;

b) a watercraft cradle having a plurality of frame members arranged to receive and support a watercraft and mounted to pivot in substantial overlying relation to said base framework between an elevated storage position whereat a supported watercraft is elevated above a waterway, and a submerged position whereat the watercraft can be manipulated onto or off of said cradle;

c) a hydraulic cylinder having a housing mounted to a pivot axle projecting from said base framework above a water level elevation and a piston mounted to a pivot axle projecting from said cradle and operable for reciprocating movement relative to said housing and wherein only a portion of said piston extended from said housing is exposed to the water when said cradle is lowered to said submerged position; and d) means for directing hydraulic fluid to said housing to control the movement of said piston.

2. Watercraft lift apparatus as set forth in claim 1 wherein said base framework includes length adjustable legs mounted to four corners of the base framework.

3. Watercraft lift apparatus as set forth in claim 1 wherein said base framework exhibits a generally rectangular shape and mounts parallel to the bed of a waterway and includes first and second upright towers that extend orthogonal to said base framework, and wherein said pivot axle of said base framework extends from one of said first and second towers.

4. Watercraft lift apparatus as set forth in claim 3 including first and second brace arms mounted to respectively extend from said first and second towers at one end of said base framework to an opposite end of said base framework.

5. Watercraft lift apparatus as set forth in claim 3 including first and second lift frames and wherein a plurality of pivot axles extend between forward and aft ends of said cradle and said base framework to contain said cradle to pivot between said elevated and submerged positions.

6. Watercraft lift apparatus as set forth in claim 3 wherein said housing lies parallel to said cradle at said elevated storage position, when said piston is fully retracted, and said housing lies at an obtuse angle relative to said cradle at said submerged position, when said piston is fully extended.

7. Watercraft lift apparatus as set forth in claim 1 wherein said pivot axle of said base framework is located above the storage position of said cradle.

8. Watercraft lift apparatus as set forth in claim 1 wherein said base framework includes first and second longitudinal members and said cradle includes third and fourth longitudinal members and said first, second, third and fourth longitudinal members are pivotally coupled to one another and said hydraulic cylinder is coupled to one of said first and second longitudinal members.

9. Watercraft lift apparatus as set forth in claim 8 including first and second lift frames coupled to forward and aft ends of said first, second, third and fourth longitudinal members from a plurality of pivot axles.

10. Watercraft lift apparatus, comprising:

a) a submersible base framework including first and second longitudinal members and a plurality of transverse members arranged in a generally rectangular shape, and wherein said base framework mounts parallel to the bed of a waterway and includes first and second upright towers that extend orthogonal to said base framework;

b) a watercraft cradle having a plurality of frame members arranged to support a watercraft and including third and fourth longitudinal members;

c) means for securing said cradle to pivot in substantial overlying relation to said base framework between an elevated storage position whereat a supported watercraft is elevated above a waterway, and a submerged position whereat the watercraft can be manipulated onto or off of said cradle;

c) a hydraulic cylinder having a housing mounted to pivot about a pivot point on one of said first and second towers above a water level elevation and a piston coupled to pivot at one of said third and fourth longitudinal members and operable for reciprocating movement relative to said housing and wherein only a portion of said piston extended from said housing is exposed to the water when said cradle is lowered to said submerged condition; and d) means for directing hydraulic fluid to said hydraulic cylinder to control the movement of said piston.

11. Watercraft lift apparatus as set forth in claim 10 wherein said housing lies parallel to said cradle at said elevated storage position, when said piston is fully retracted, and said housing lies at an obtuse angle relative to said cradle at said submerged position, when said piston is fully extended.

12. Watercraft lift apparatus as set forth in claim 10 wherein said base framework includes length adjustable legs mounted to four corners of the base framework.

13. Watercraft lift apparatus as set forth in claim 10 including first and second lift frames coupled to forward and aft ends of said cradle and wherein a plurality of pivot axles extend between said cradle and said base framework to contain said cradle to pivot between said elevated and submerged positions.

14. Watercraft lift apparatus as set forth in claim 10 including first and second brace arms mounted to respectively extend from said first and second towers at one end of said base framework to an opposite end of said base framework.

15. Watercraft lift apparatus, comprising:

a) a submersible base framework including first and second longitudinal members and a plurality of transverse members arranged in a generally rectangular shape and a plurality of length adjustable legs mounted to said base framework, and wherein said base framework mounts parallel to the bed of a waterway and includes first and second upright towers that extend orthogonal to and from one end of said base framework and first and second brace members that extend from said first and second towers to an opposite end of said base framework;

b) a watercraft cradle having a plurality of frame members arranged to support a watercraft and including third and fourth longitudinal members;

c) first and second frames pivotally secured to said first and second longitudinal members and to said third and fourth longitudinal members, such that said cradle pivots relative to said base framework between an elevated storage position whereat a supported watercraft is elevated above a waterway, and a submerged position whereat the watercraft can be manipulated onto or off of said cradle; and d) first and second hydraulic cylinders each having a housing mounted to a pivot point at said respective first and second towers above a water level elevation and a piston coupled to pivot at said cradle and operable for reciprocating movement relative to said housing, wherein said first and second brace members extend from a position above the pivotal couplings of said first and second cylinders to said first and second towers to said first and second longitudinal members, and wherein only a portion of said piston extended from said housing is exposed to the water when said cradle is lowered to said submerged position; and d) means for directing hydraulic fluid to said first and second hydraulic cylinders to control the movement of the pistons thereof.

* * * * *